US010716408B2

(12) United States Patent
Yang

(10) Patent No.: US 10,716,408 B2
(45) Date of Patent: Jul. 21, 2020

(54) AIR PUMP WITH TWO FANS

(71) Applicant: DONGGUAN HONGSHENG METAL & PLASTIC TECHNOLOGY CO., LTD., Dongguan (CN)

(72) Inventor: Chunhua Yang, Guangdong (CN)

(73) Assignee: DONGGUAN HONGSHENG METAL & PLASTIC TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 16/671,548

(22) Filed: Nov. 1, 2019

(65) Prior Publication Data

US 2020/0063745 A1 Feb. 27, 2020

(30) Foreign Application Priority Data

Sep. 5, 2019 (CN) ..... 2019 2 1476677 U

(51) Int. Cl.

| | |
|---|---|
| ***A47C 27/08*** | (2006.01) |
| ***F04D 25/10*** | (2006.01) |
| ***F04D 25/16*** | (2006.01) |
| ***F04D 25/06*** | (2006.01) |
| ***F04D 25/08*** | (2006.01) |
| ***F04D 29/08*** | (2006.01) |

(52) U.S. Cl.

CPC ..... *A47C 27/082* (2013.01); *F04D 25/0606* (2013.01); *F04D 25/068* (2013.01); *F04D 25/08* (2013.01); *F04D 25/10* (2013.01); *F04D 25/16* (2013.01); *F04D 29/083* (2013.01)

(58) Field of Classification Search

CPC ..... F04D 25/083; F04D 25/10; F04D 25/16; F04D 25/068; F04D 25/0606; F04D 25/08; F04D 29/083; A47C 27/082

See application file for complete search history.

(56) References Cited

U.S. PATENT DOCUMENTS

| | | | | |
|---|---|---|---|---|
| 2,251,553 A * | 8/1941 | Redmond | B60H 1/00457 | 417/350 |
| 2,337,325 A * | 12/1943 | Hach | F24F 7/00 | 454/205 |
| 2,373,497 A * | 4/1945 | Paiste, Jr. | F24F 7/013 | 417/315 |
| 6,990,700 B2 * | 1/2006 | Chung | A45B 19/02 | 5/713 |
| 8,157,535 B2 * | 4/2012 | Wang | A47C 27/082 | 417/26 |
| 2008/0232982 A1 * | 9/2008 | Boyd | F04D 25/084 | 417/315 |

* cited by examiner

*Primary Examiner* — Charles G Freay
(74) *Attorney, Agent, or Firm* — Shimokaji IP

(57) ABSTRACT

A housing of the air pump has a first air inlet, an air inlet passage, an inflation inlet, an air outlet passage and an air outlet. The motor has two output shafts, the first fan is connected with one of the output shafts and located at one end of the air inlet passage, and the second fan is connected with another output shaft and located at one end of the air outlet passage. The second and the first fans are configured to rotate at a same direction, and the inflation inlet is located between the first and the second fans. The first switch unit is adapted to connect or disconnect the first air inlet with the air inlet passage, and the second switch unit is adapted to connect or disconnect the air outlet with the air outlet passage. The air pump has simple structure, convenient control and low cost.

17 Claims, 14 Drawing Sheets

AIR PUMP WITH TWO FANS

FIELD OF THE INVENTION

The present invention relates to an air pump, and more particularly to an air pump adapted for installing in an air bag to inflate or deflate the air bag.

BACKGROUND OF THE INVENTION

With the widespread use of inflatable products, the volume of inflatable products has increased, and the difficulty of manual inflation has become more and more serious, therefore electric air pumps have been developed. For example, a large inflatable bed for children is usually provided with an electric air pump inside, which is inflated by internal inflation, so that children can play on the bed. However, as time goes by, the air in the inflatable bed leaks slowly, thus it is necessary to replenish with air regularly. At this time, the electric air pump is required to start. In addition, when the air bed is not in use, it is required to be deflated for transportation and storage. In these operations, the electric air pump has greatly facilitated.

However, most of the existing electric air pumps only have an inflation function, and it is necessary to naturally deflate from another vent or deflate by using another deflation pump when deflation is needed. Such a deflation method is inconvenient, inefficient and costly. Some types of electric air pumps with inflation and deflation functions include a motor, a fan, an air passage and an air inlet. During inflation, the motor is controlled to rotate forward by the control circuit, thereby driving the fan to rotate forward, thereby driving to cause the airflow enter from the air inlet to the inflation inlet through the air passage, thereby automatically inflating the air bag. At the time of deflation, the control circuit controls the reversal of the motor, which in turn drives the fan to reverse, thereby discharging the air in the air bag from the inflation inlet to the outside. However, since the electric air pump is provided with only one fan, thus the flow direction of the airflow is controlled only by the forward or reverse rotation of the fan, that is to say, it is necessary to control the forward and reverse rotation of the output shaft of the motor, which requires adding a control circuit control. As a result, the production cost is increased.

SUMMARY OF THE INVENTION

One objective of the present invention is to provide an air pump adapted for installing in the air bag to selectively automatically inflate or deflate the air bag, which has simple structure, convenient control and low cost.

To achieve the mentioned above objective, the present invention provides an air pump including:

a housing, provided with a first air inlet, an air inlet passage, an inflation inlet, an air outlet passage and an air outlet;

a motor, having two output shafts;

a first fan, connected with one of the output shafts of the motor and located at one end of the air inlet passage;

a second fan, connected with another of the output shafts of the motor and located at one end of the air outlet passage, the second fan and the first fan being configured to rotate at a same direction, and the inflation inlet being located between the first fan and the second fan;

a first switch unit, configured at another end of the air inlet passage to connect or disconnect the first air inlet with the air inlet passage; and a second switch unit, configured at another end of the air outlet passage to connect or disconnect the air outlet with the air outlet passage.

In comparison with the prior art, the motor having two output shafts is provided in the present invention, and the first fan and second fan are configured at both ends of the dual output shafts. Specifically, the first fan is located at one end of the air inlet passage, and the second fan is located at another end of the air outlet passage, further the inflation inlet is configured between the first fan and the second fan. Therefore, when the motor is started, the airflow at the first air inlet is driven by the first fan to the air inlet through the air inlet passage, and the airflow at the inflation inlet is driven by the second fan to the air outlet through the air outlet passage. Therefore, after the first switch unit is disposed at the first air inlet 11*a* and the second switch unit is disposed at the air outlet, the first switch unit is turned on, and the second switch unit is turned off, in such a way, the air bag is inflated by means of the air inlet passage and the first fan. While the first switch unit is turned off, and the second switch unit is turned on, the air bag is deflated by means of the second fan and the air outlet passage. Since two fans are provided, thus it's unnecessary to reverse the motor and set a control circuit to control the reverse rotation of the motor to achieve inflation or deflation. The structure is very simple and ingenious, and the control is simple, which effectively reduces the cost of the whole machine.

Preferably, a motor receiving cavity is provided within the housing, in which the motor, the first fan and the second fan are received, one end of the motor receiving cavity is intercommunicated with one end of the air inlet passage, and another end of the motor receiving cavity is intercommunicated with one end of the air outlet passage, and the inflation inlet is configured at a side wall of the motor receiving cavity.

Preferably, a first receiving cavity and a second receiving cavity are provided with the housing, the first receiving cavity is intercommunicated with the first air inlet and air inlet passage respectively, the second receiving cavity is intercommunicated with the air outlet and the air outlet passage, the first switch unit is configured in the first receiving cavity, and the second switch unit is configured in the second receiving cavity.

Preferably, the first switch unit and/or the second switch unit are configured to be rotatable relative to the housing, so as to connect or disconnect with the first air inlet and the air inlet passage.

Preferably, the first switch unit and/or the second switch unit are configured to be movable relative to the housing, so as to connect or disconnect with the first air inlet and the air inlet passage.

Preferably, the first switch unit comprises a switch button, a support plate configured at a lower side of the switch button, and a sealing element configured on the support plate, the switch button is extruded out of the first air inlet, and the sealing element is tightly pressed on the first air inlet or departs from the first air inlet when the switch button is actuated.

Preferably, a limiting portion is extended from a side wall of the switch button, and the sealing element is configured between the limiting portion and the support plate.

Preferably, the first switch unit comprises a switch button having a cavity therein, a connecting member configured in the cavity, and a sealing element sleeved on the connecting member, and the sealing element is tightly pressed on the first air inlet or departs from the first air inlet when the switch button is actuated.

Preferably, the connecting member comprises a main body, a limiting portion extended from an outer wall of the main body, and a limiting member detachably configured at a lower end of the main body, the sealing element is configured between the limiting portion and the limiting member.

Preferably, a top of the switch button is provided with a second inflation inlet which is interconnected with the cavity.

Preferably, the switch button is provided with a guide part extending outwards, a guide rail is configured in the housing, and the guide part is slidably configured on the guide rail to actuate the switch button.

Preferably, the guide rail is a spiral rail.

Preferably, two engaging grooves are configured at a highest point of the spiral rail and a lowest point of the spiral rail.

Preferably, the first switch unit further comprises a spring element configured between the switch button and the housing, to supply a spring force to the switch button for extruding from of the housing.

Preferably, the second switch unit has identical structure with the first switch unit.

Preferably, an electric control box is configured in the housing, in which a circuit board for controlling the motor is set.

Preferably, the air pump further comprises an automatic air replenishing pump, wherein the housing is provided with a USB interface connected with the circuit board, and the automatic replenishing pump is connected with the USB interface via a cable to connect with the air pump.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

The present invention will be described in detail below with reference to the accompanying drawings and preferred embodiments.

As illustrated in FIGS. 1-6, an air pump of a first embodiment of the present invention is shown.

Figure 1:
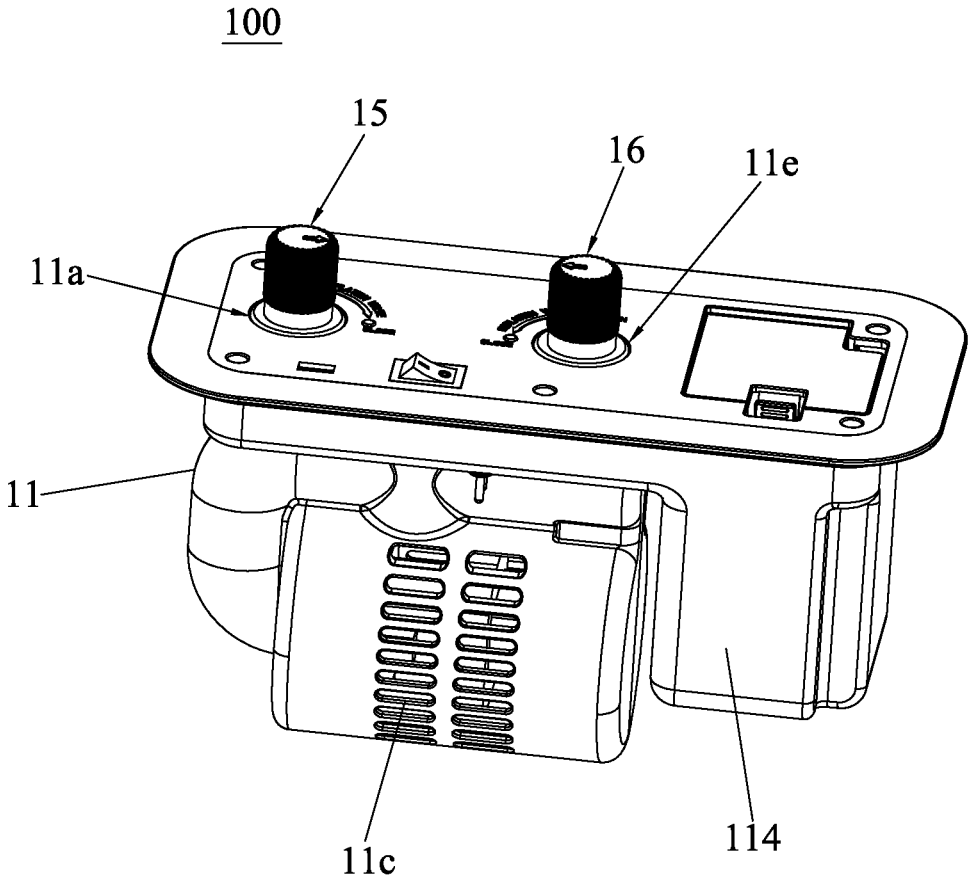
FIG. 1 is a perspective view of an air pump according to a first embodiment of the present invention.
Figure 2:
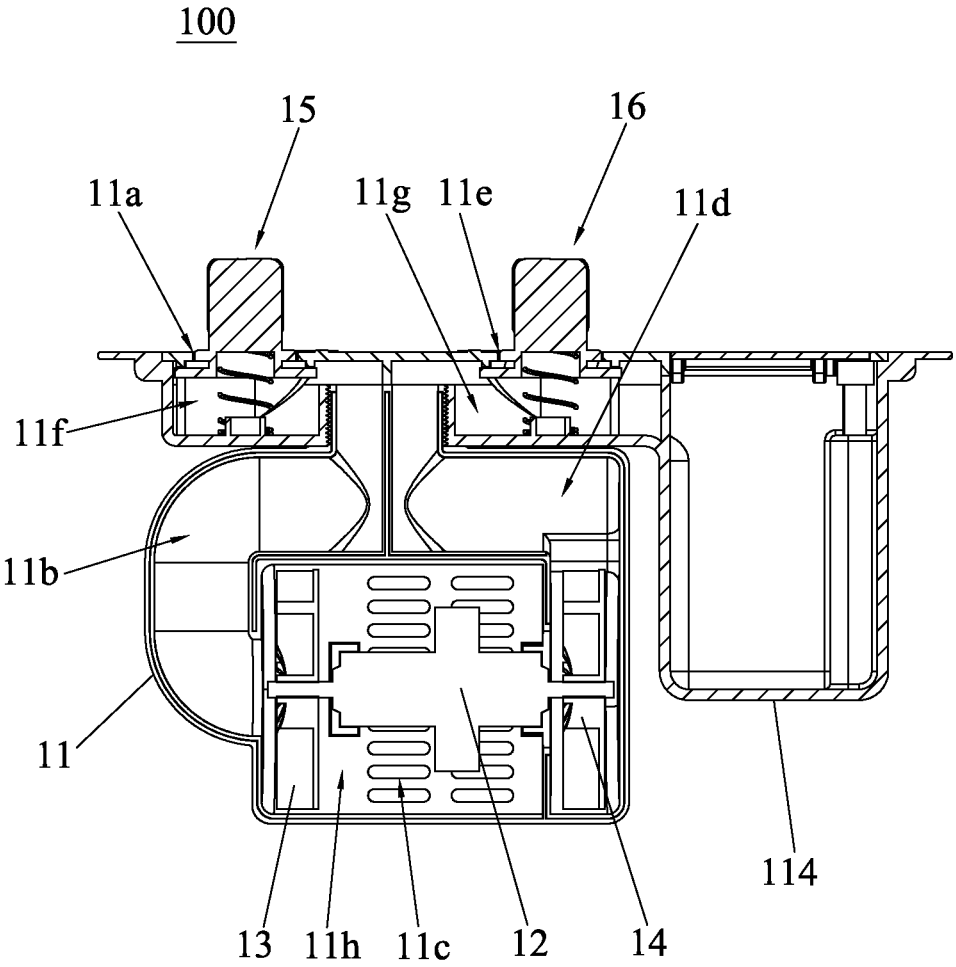
FIG. 2 is a schematic view of the air pump according to the first embodiment of the present invention.

Referring to FIGS. 1 and 2, the air pump 100 is installed inside a gas bag to inflate the air bag, and the air pump 100 includes a housing 11, a motor 12, a first fan 13, a second fan 14, a first switch unit 15 and a second switch unit 16. Specifically, the housing 11 is provided with a first air inlet 11*a*, an air inlet passage 11*b*, an inflation inlet 11*c*, an air outlet passage 11*d* and an air outlet 11*e*, the first air inlet 11*a* and the air outlet 11*e* are extruded out of the outside of the air bag, and the air outlet 11*e* is located in the air bag and intercommunicated with the interior of the air bag. The first air inlet 11*a* and the air outlet 11*e* are circular. The motor 12 have two output shafts, the first fan 13 is connected with one of the output shafts of the motor 12 and located at one end of the air inlet passage, and the second fan 14 is connected with another of the output shafts of the motor 12 and located at one end of the air outlet passage 11*d*. Specifically, the second fan 14 and the first fan 13 are configured to be rotatable at a same direction, and the inflation inlet 11*c* is located between the first fan 13 and the second fan 14. The first switch unit 15 is configured at another end of the air inlet passage 11*b* to connect or disconnect the first air inlet 11*a* with the air inlet passage 11*b*, and a second switch unit 16 is configured at another end of the air outlet passage 11*d* to connect or disconnect the air outlet 11*e* with the air outlet passage 11*d*.

Referring to FIGS. 1 and 2, a first receiving cavity 11*f*, a second receiving cavity 11*g* and a motor receiving cavity 11*h* are formed within the housing 11. The motor 12, the first fan 13 and the second fan 14 are received in the motor receiving cavity 11*h*, one end of the motor receiving cavity 11*h* is intercommunicated with one end of the air inlet passage 11*b*, and another end of the motor receiving cavity 11*h* is intercommunicated with one end of the air outlet passage 11*d*, and the inflation inlet 11*c* is configured at a side wall of the motor receiving cavity 11*h*. Due to the motor receiving cavity 11*h*, the motor 12, the first fan 13 and the second fan 14 can be installed steadily, and the airflow can be gathered to the inflation inlet 11*c*, meanwhile the heat energy of the motor 12 can be taken away while the airflow flows through the motor 12, which has a certain heat dissipation effect on the motor 12. The first receiving cavity 11*f* is intercommunicated with the first air inlet 11*a* and the air inlet passage 11*b* respectively, and the second receiving cavity 11*g* is intercommunicated with the air outlet 11*e* and the air outlet passage 11*d* respectively, the first switch unit 15 is disposed in the first receiving cavity 11*f*, and the second switch unit 16 is disposed in the second receiving cavity 11*g*.

Referring to FIG. 2, the first switch unit 15 and the second switch unit 16 are configured to be rotatable relative to the housing 11, so as to connect or disconnect with the first air inlet 11*a* and the air inlet passage 11*b*. Alternatively, the first switch unit 15 and the second switch unit 16 are configured to be movable relative to the housing 11, so as to connect or disconnect with the first air inlet 11*a* and the air inlet passage 11*b*.

Figure 3:
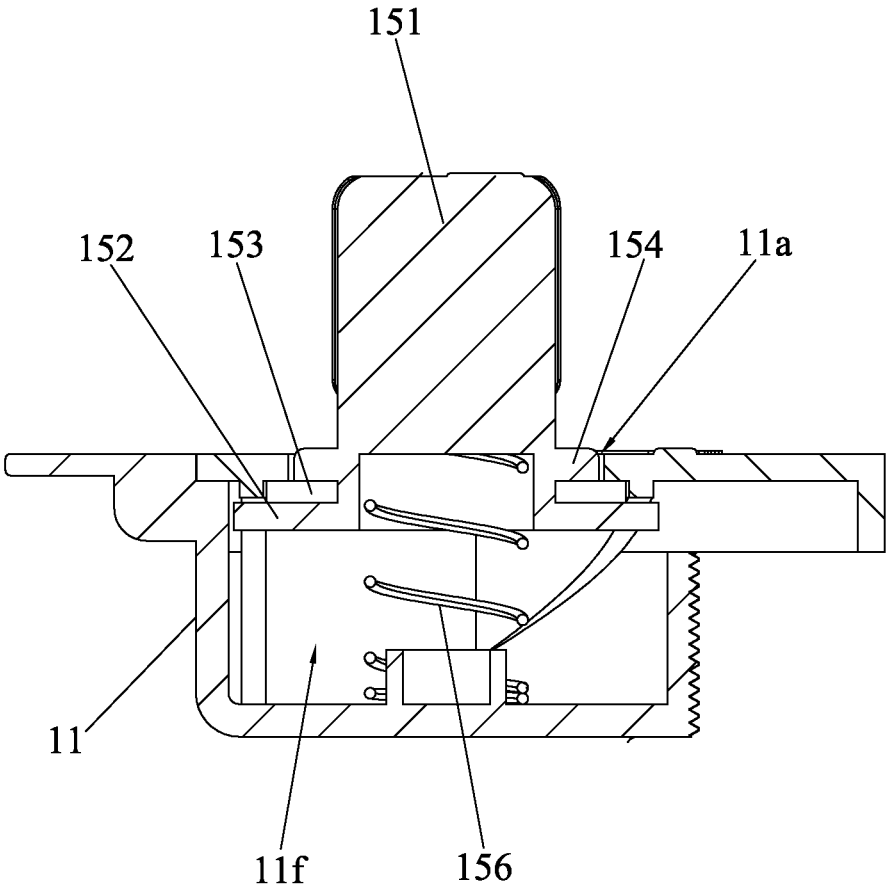
FIG. 3 is a schematic view of a first switch unit of the air pump according to the first embodiment of the present invention.
Figure 4:
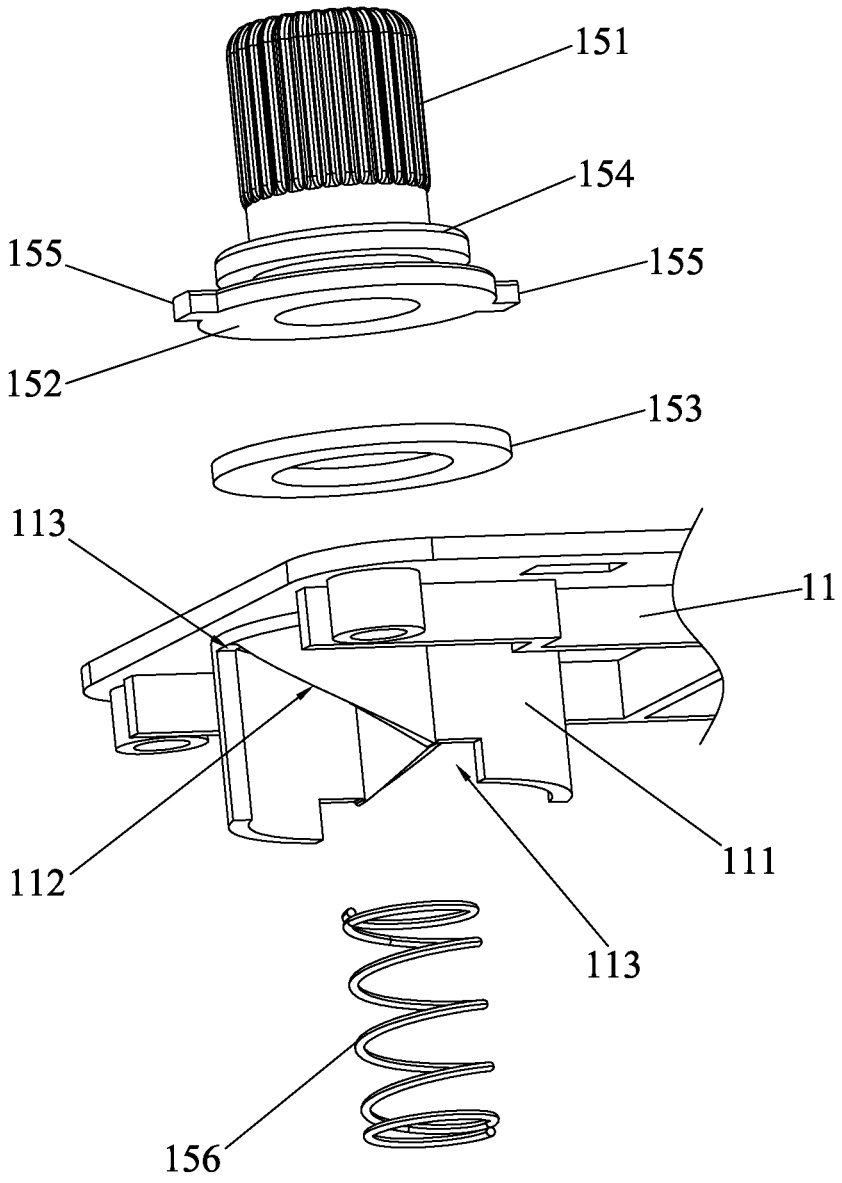
FIG. 4 is an exploded view of the first switch unit of the air pump according to the first embodiment of the present invention.

Specifically, referring to FIGS. 3 and 4, the first switch unit 15 includes a switch button 151, a support plate 152 configured at a lower side of the switch button 151, and a sealing element 153 configured on the support plate 152. The switch button 151 is rotatable about a central axis thereof, and the central axis of the switch button 151 coincides with the central axis of the first air inlet 11*a*. Further, the switch button 151 is also movable in the direction of the central axis of the first air inlet 11*a* so as to be able to extend or retract into the first air inlet 11*a*. A limiting portion 154 is extended from a middle wall of the switch button 151, and the sealing element 153 is configured between the limiting portion 154 and the support plate 152. The switch button 151 is cylindrical, the support plate 152 is circular, the sealing element 153 is a flat and annular sealing piece, and the limiting portion 154 is circular. The outer diameter of the limiting portion 154 is smaller than the outer diameter of the sealing element 153 such that the upper surface of the sealing element 153 is exposed to be in contact with the inner side of the first air inlet 11*a*. The outer diameter of the sealing element 153 is not greater than the outer diameter of the support plate 152, thereby ensuring that the edge of the sealing element 153 will not bent. The support plate 152 is simultaneously restrained with the limiting portion 154 to position the sealing element 153 firmly, thereby improving the sealing performance. When the switch button 151 is actuated, the sealing element 153 may be hermetically attached to the first air inlet 11*a* or away from the first air inlet 11*a*. In summary, by providing the sealing element 153 on the support plate 152, the sealing element 153 can be pressed against the first air inlet 11*a* when the switch button 151 protrudes from the first air inlet 11*a*, such that the first air inlet 11*a* is sealed, otherwise, the first air inlet 11*a* and the air inlet passage 11*b* are interconnected.

Referring to FIGS. 3 and 4 again, the switch button 151 is provided with a guide part 155 extending outwards and locating at an edge of the support plate 152, and the amount of the guide part 155 is two preferably, and two guide parts 155 are configured at two opposite sides of the switch button 151. A guide plate 111 is extended downwards from the inner side of the housing 11, and a guide rail 112 is configured at two sides of the guide plate 111 symmetrically, and specifically, the guide part 111 is slidably configured on the guide rail 112 to actuate the switch button 151. Preferably, the guide rail 112 is a spiral rail. By providing the spiral rail, the guide part 155 is slid on the spiral rail, so that the switch button 151 can be rotated while moving up and down, thereby driving the seal element 153 to move, so that the first air inlet 11*a* can be disconnected or connected with the air inlet passage 11*b*. In addition, the highest point and the lowest point of the spiral rail are respectively provided with an engaging groove 113 which is engaged with the guiding part 155 to position the switch button 151. By providing the engagement groove 113, the guide part 155 can be positioned at the highest point and the lowest point to position the current state of the switch button 151 to maintain the disconnection or connection state of the first air inlet 11*a* and the air inlet passage 11*b*, thereby achieving the function of sealing or continuous inflation.

Referring to FIG. 3 again, the first switch unit 15 further includes a spring element 156 configured between the switch button 151 and the housing 11, to supply a spring force to the switch button 151 for extruding from the housing 11. In such a way, the switch button 151 can be automatically reset to improve the convenience of operation. Preferably, the spring element 156 is a compression spring. In this embodiment, when the guiding part 155 is engaged in the engaging groove 113 of the highest point of the spiral rail, the compression spring is in an extended state, the switch button 151 extends out of the first air inlet 11*a*, and the seal 153 is sealed to the first air inlet 11*a*. When the guiding part 155 is engaged in the engaging groove 113 at the lowest point of the spiral rail, the compression spring is in a compressed state, the switch button 151 is retracted into the first air inlet 11*a*, and the sealing element 153 departs from the first air inlet 11*a*, and further the first air inlet 11*a* is interconnected with the air inlet passage 11*b*. The second switch unit 16 has the same structure as the first switching unit 15, except that the second switch unit 16 controls disconnection or connection between the air outlet 11*e* and the air outlet passage 11*d*. It's easy for person skilled in the art to know the structure and connection relationship of the second switch unit 16 according to the structure and connection relationship of the first switch unit 15. Therefore, the structure and connection relationship of the second switch unit 16 are not repeated here.

Specifically, an electric control box 114 is configured in the housing 11, in which a circuit board for controlling the motor 12 is set, and the electric control box 114 is configured at a side of the housing 11.

Figure 5:
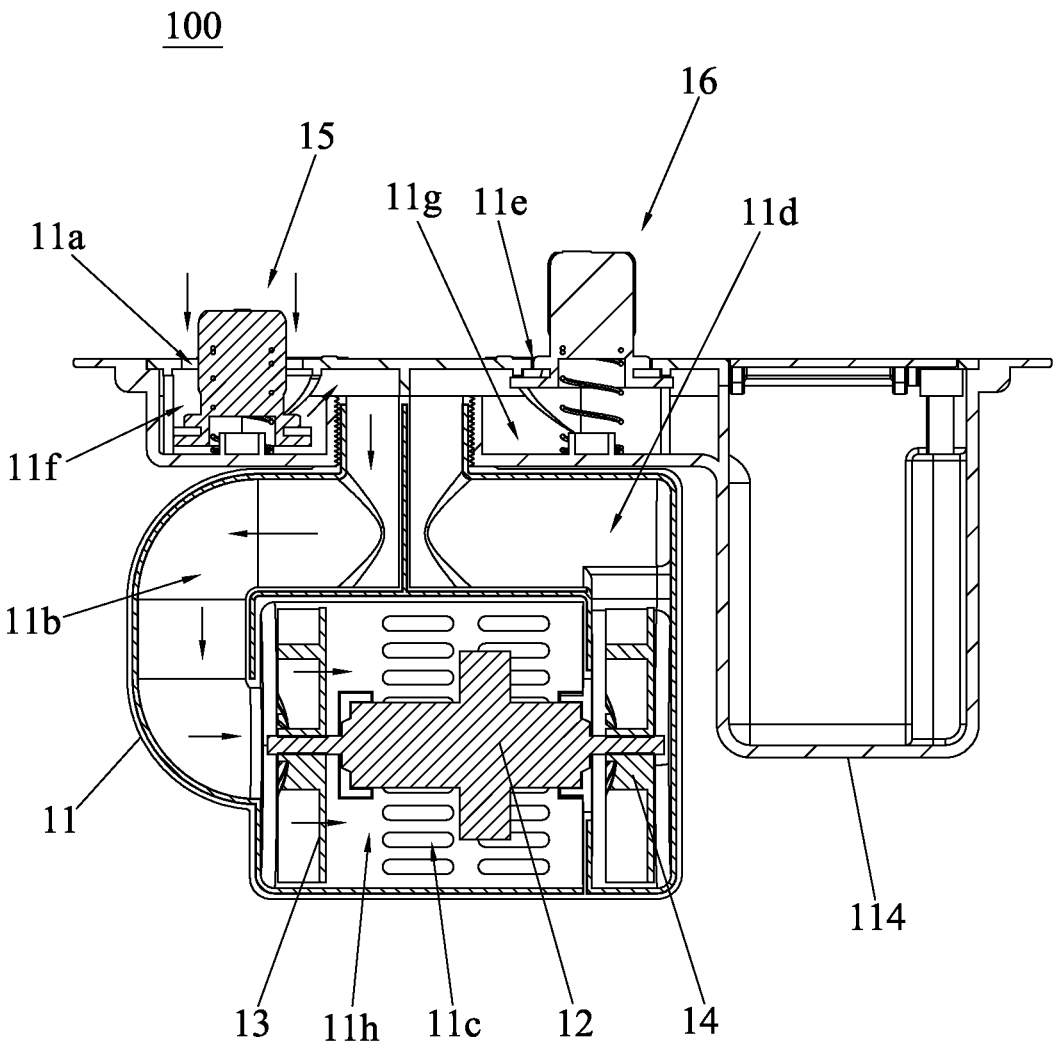
FIG. 5 shows a status of the air pump during inflation according to the first embodiment of the present invention.
Figure 6:
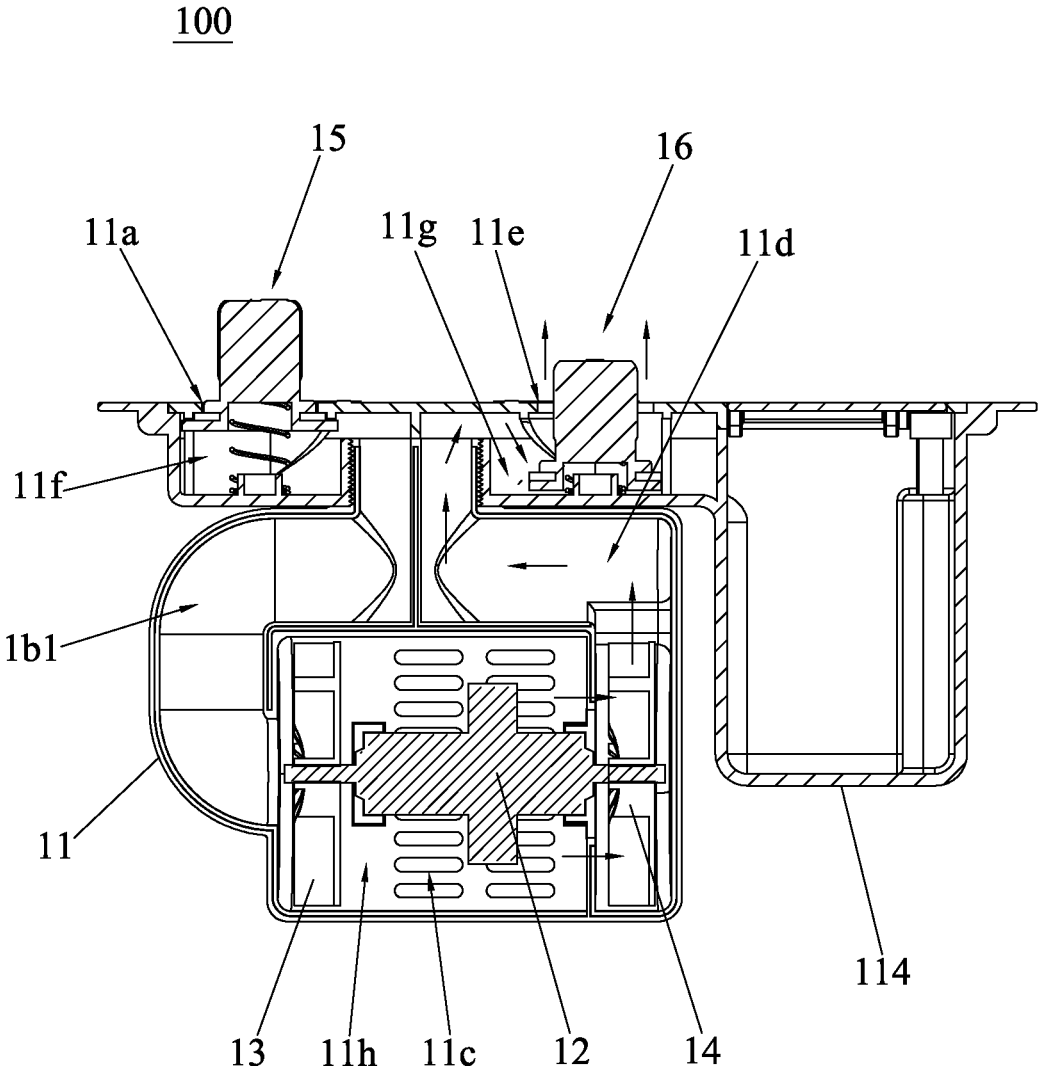
FIG. 6 shows a status of the air pump during deflation according to the first embodiment of the present invention.

Referring to the above and in conjunction with FIGS. 5 and 6, the working principle of the air pump 100 of the first embodiment follows.

As shown in FIG. 5, before the inflation, the first switch unit 15 is operated, and the switch button 151 is turned to rotate. At this time, the guiding part 155 is withdrawn from the highest point of the spiral rail, and slides along the spiral rail to reach the lowest point thereby engaging in the engaging groove 113. In the process, the state of the switch button 151 is changed from the closed state to the opened state, that is, the switch button 151 is retracted into the first air inlet 11*a*, and the sealing element 153 departs from the first air inlet 11*a*. At this time, the first air inlet 11*a* intercommunicates with the air inlet passage 11*b*. The second switch unit 16 keeps closing the air outlet 11*e*. Then, the motor 12 is activated to rotate the dual output shaft, and the first fan 13 and the second fan 14 are simultaneously rotated. Since the first air inlet 11*a* is in communication with the air inlet passage 11*b*, the airflow flows from the first air inlet 11*a* into the first receiving cavity 11*f* under the actuation of the first fan 13, and enters the motor receiving cavity 11*h* through the first air inlet 11*a*, and finally inflate the air bag from the inflation inlet 11*c* into the air bag. Further, when the second switch unit 16 closes the air outlet 11*e*, the airflow cannot be discharged outward from the air outlet 11*e* although the second fan 14 is rotating. After the air bag is fully inflated, the motor 12 is stopped, meanwhile the first switch unit 15 is operated, and the switch button 151 is turned to rotate in the reverse direction, causing the guiding part 155 disengage from the lowest point of the spiral rail and then engage in the engaging groove 113 automatically at the highest point of the spiral rail under the elastic restoring force of the spring element 156. In this process, the switch button 151 is turned from an open state to a closed state, that is, the switch button 151 is extended out of the first air inlet 11*a*, and the sealing element 153 is actuated to seal the first air inlet 11*a*. At this time, the first air inlet 11*a* is blocked from the air inlet passage 11*b*, and the first air inlet 11*a* is closed by the first switch unit 15.

As shown in FIG. 6, during the deflation, the second switch unit 16 is operated, and the operation of the second switch unit 16 and each component therein are the same as those of the first switch unit 15. In such a way, the air outlet 11*e* can be opened to communicate the air outlet 11*e* with the exhaust passage 11*d*. After that, the motor 12 is restarted, so that the first fan 13 and the second fan 14 rotate, and the airflow in the air bag flows into the motor receiving cavity 11*h* from the inflating inlet 11*c*, and passes through the air outlet passage 11*d* to reach the second receiving cavity 11*g*, and is finally discharged to the outside from the air outlet 11*e*. After the air in the air bag is completely discharged, the motor 12 is stopped while the second switch unit 16 is operated to block the air outlet 11*e* from the air outlet passage 11*d*. That is, the first air inlet 11*a* is closed by the second switching device 16.

Compared with the prior art, the motor 12 having two output shafts is provided in the present invention, and the first fan 13 and second fan 14 are configured at both ends of the dual output shafts. Specifically, the first fan 13 is located at one end of the air inlet passage 11*b*, and the second fan 14 is located at another end of the air outlet passage 11*d*, further the inflation inlet 11*c* is configured between the first fan 13 and the second fan 14. Therefore, when the motor 12 is started, the airflow at the first air inlet 11*a* is driven by the first fan 13 to the air inlet 11*c* through the air inlet passage 11*b*, and the airflow at the inflation inlet 11*c* is driven by the second fan 14 to the air outlet 11*e* through the air outlet passage 11*d*. Therefore, after the first switch unit 15 is disposed at the first air inlet 11*a* and the second switch unit 16 is disposed at the air outlet 11*e*, the first switch unit 15 is turned on, and the second switch unit 16 is turned off, in such a way, the air bag is inflated by means of the air inlet passage 11*b* and the first fan 13. While the first switch unit 15 is turned off, and the second switch unit 16 is turned on, the air bag is deflated by means of the second fan 14 and the air outlet passage 11*d*. Since two fans are provided, thus it's unnecessary to reverse the motor 12 and set a control circuit to control the reverse rotation of the motor 12 to achieve inflation or deflation. The structure is very simple and ingenious, and the control is simple, which effectively reduces the cost of the whole machine.

As shown in FIGS. 7-12, the structure of the air pump 200 of the second embodiment of the present invention is shown.

Figure 7:
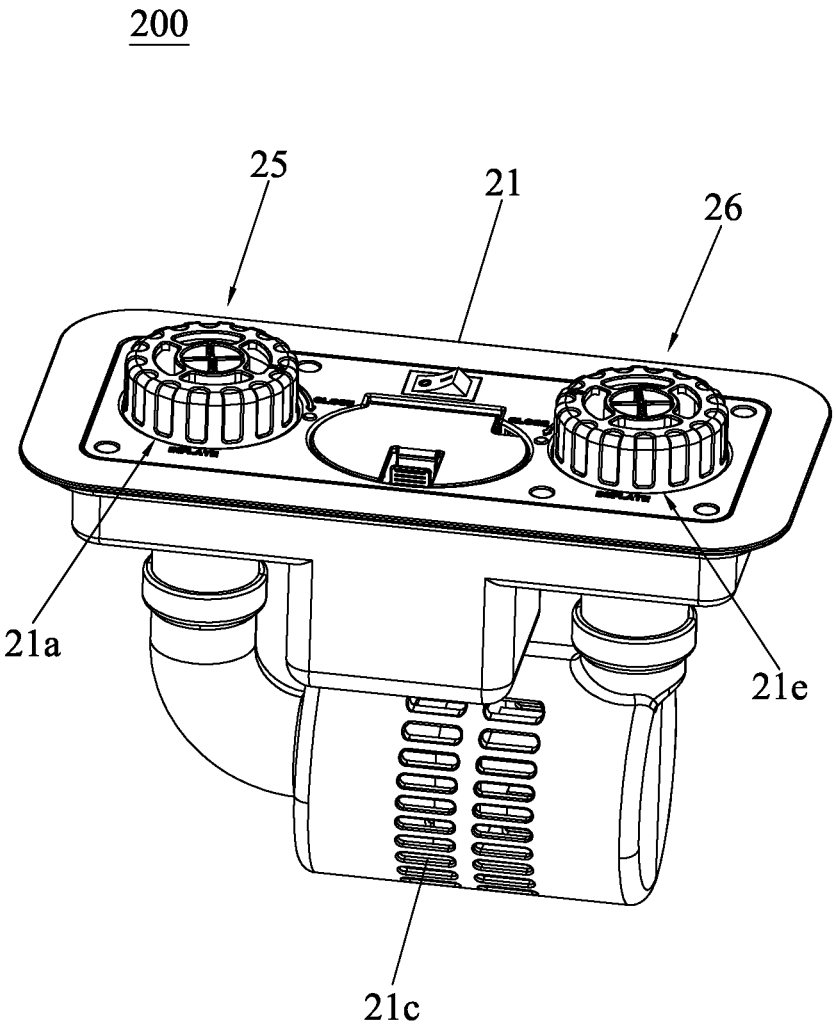
FIG. 7 is a perspective view of an air pump according to a second embodiment of the present invention.
Figure 8:
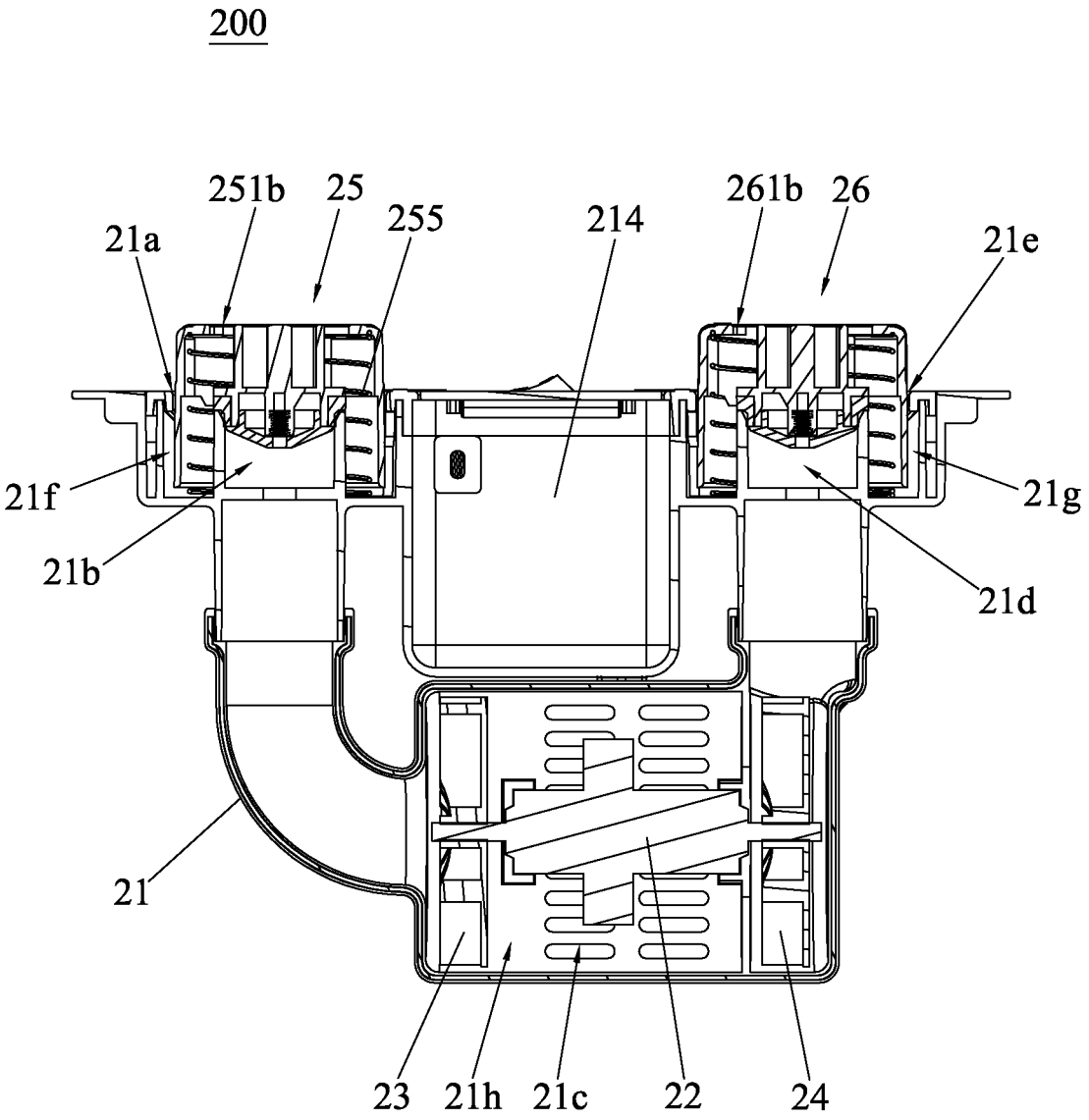
FIG. 8 is a schematic view of the air pump according to the second embodiment of the present invention.

Referring to FIGS. 7 and 8, the air pump 100 includes a housing 21, a motor 22, a first fan 23, a second fan 24, a first switch unit 25 and a second switch unit 26. Specifically, the housing 21 is provided with an first air inlet 21*a*, an air inlet passage 21*b*, an inflation inlet 21*c*, an air outlet passage 21*d* and an air outlet 21*e*, the first air inlet 21*a* and the air outlet 21*e* are extruded out of the outside of the air bag, and the air outlet 21*e* is located in the air bag and intercommunicated with the interior of the air bag. The first air inlet 21*a* and the air outlet 21*e* are circular. The motor 22 have two output shafts, the first fan 23 is connected with one of the output shafts of the motor 22 and located at one end of the air inlet passage, and the second fan 24 is connected with another of the output shafts of the motor 22 and located at one end of the air outlet passage 21*d*. Specifically, the second fan 24 and the first fan 23 are configured to be rotatable at a same direction, and the inflation inlet 11*c* is located between the first fan 23 and the second fan 24. The first switch unit 25 is configured at another end of the air inlet passage 21*b* to connect or disconnect the first air inlet 21*a* with the air inlet passage 21*b*, and a second switch unit 16 is configured at another end of the air outlet passage 21*d* to connect or disconnect the air outlet 21*e* with the air outlet passage 21*d*.

Referring to FIGS. 7 and 8, a first receiving cavity 21*f*, a second receiving cavity 21*g* and a motor receiving cavity 21*h* are formed within the housing 21. The motor 22, the first fan 23 and the second fan 24 are received in the motor receiving cavity 21*h*, one end of the motor receiving cavity 21*h* is intercommunicated with one end of the air inlet passage 21*b*, and another end of the motor receiving cavity 21*h* is intercommunicated with one end of the air outlet passage 21*d*, and the inflation inlet 21*c* is configured at a side wall of the motor receiving cavity 21*h*. Due to the motor receiving cavity 21*h*, the motor 22, the first fan 23 and the second fan 24 can be installed steadily, and the airflow can be gathered to the inflation inlet 21*c*, meanwhile the heat energy of the motor 22 can be taken away while the airflow flows through the motor 22, which has a certain heat dissipation effect on the motor 22. The first receiving cavity 21*f* is intercommunicated with the first air inlet 21*a* and the air inlet passage 21*b* respectively, and the second receiving cavity 21*g* is intercommunicated with the air outlet 21*e* and the air outlet passage 21*d* respectively, the first switch unit 25 is disposed in the first receiving cavity 21*f*, and the second switch unit 26 is disposed in the second receiving cavity 21*g*.

Referring to FIG. 8, the first switch unit 25 and the second switch unit 26 are configured to be rotatable relative to the housing 21, so as to connect or disconnect with the first air inlet 21*a* and the air inlet passage 21*b*. Alternatively, the first switch unit 25 and the second switch unit 26 are configured to be movable relative to the housing 21, so as to connect or disconnect with the first air inlet 21*a* and the air inlet passage 21*b*.

Figure 9:
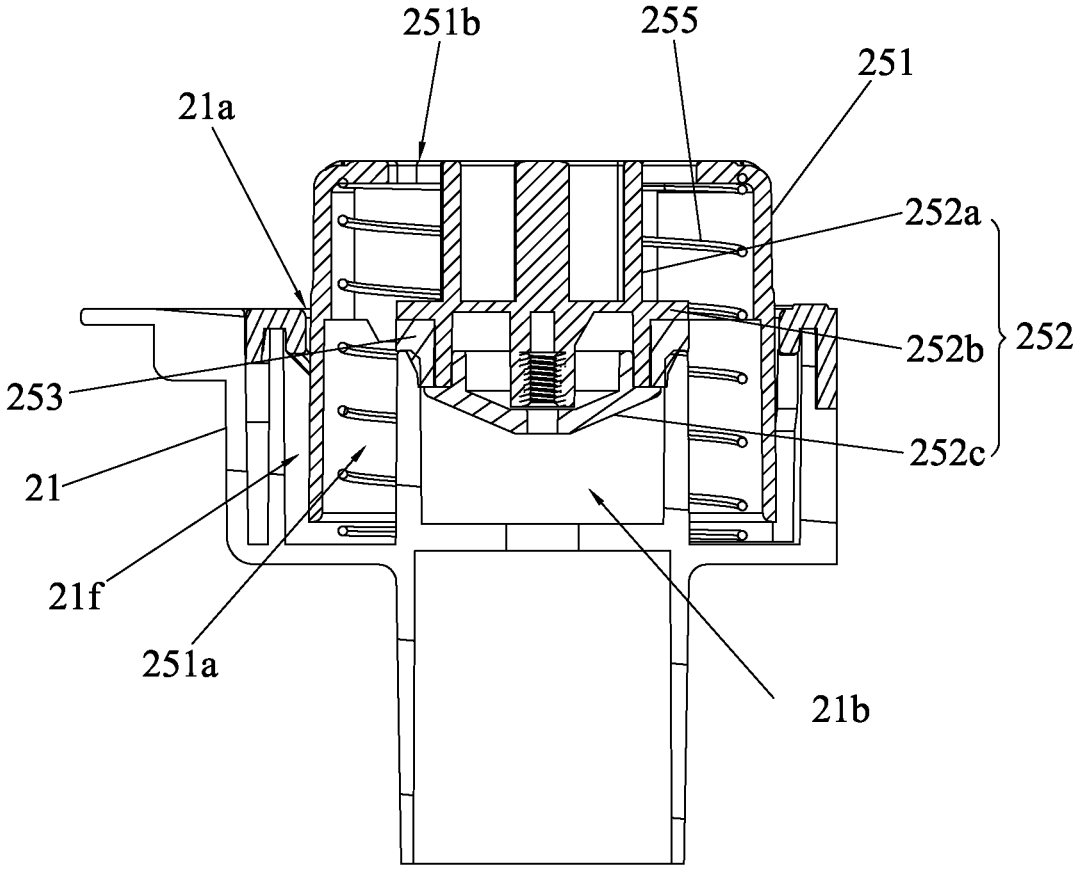
FIG. 9 is a schematic view of a first switch unit of the air pump according to the second embodiment of the present invention.
Figure 10:
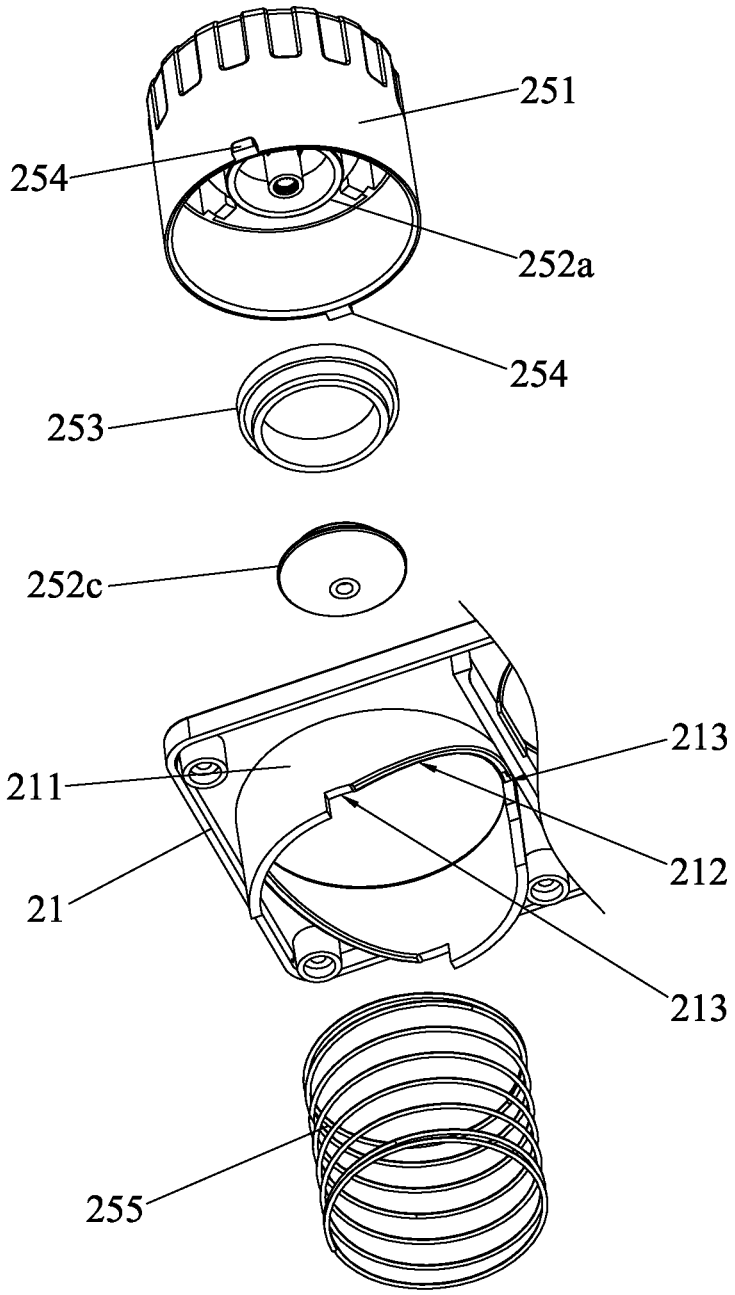
FIG. 10 is an exploded view of the first switch unit of the air pump according to the second embodiment of the present invention.

Specifically, referring to FIGS. 9 and 10, the first switch unit 25 includes a switch button 251 having a cavity 251*a*, a connecting member 252 configured inside the cavity 251*a*, and a sealing element 253 sleeved around the connecting member 252. The switch button 251 is provided with a second inflation inlet 251*b* intercommunicated with the cavity 251*a*. When the switch button 251 is configured in the first receiving cavity 21*f*, the cavity 251*a* is intercommunicated with the first receiving cavity 21*f* as well. The switch button 251 is rotatable about a central axis thereof, and the central axis of the switch button 251 coincides with the central axis of the first air inlet 11*a*. Further, the switch button 251 is also movable in the direction of the central axis of the first air inlet 21*a* so as to be able to extend or retract into the first air inlet 21*a*.

As shown in FIGS. 9 and 10, the connecting member 252 includes a main body 252*a*, a limiting portion 252*b* extended from the main body 252*a* and a limiting member 252*c* detachably formed at a lower end of the main body 252*a*, and the sealing element 253 is sleeved between the limiting portion 252*b* and the limiting member 252*c*. The switch button 251 is cylindrical, the limiting portion 252*b* is circular, the sealing element 253 is a cylindrical sealing ring whose diameter is gradually reduced from its upper end to its lower end, and the diameter of the upper end of the sealing ring is not greater than the diameter of the limiting portion 252*b*. The limiting member 252*c* has an inverted cone structure, the diameter of the lower end of the sealing ring is equal to the diameter of the top of the limiting member 252*c*, and the diameter of the inlet of the air inlet 21*a* is between the diameter of the upper end of the seal ring and the diameter of the lower end of the sealing ring. The limiting member 252*c* is fixed to the lower end of the main body 252*a* by a screw connection. Since the limiting member 252*c* can be detached from the main body 252*a*, thus the sealing element 253 can be fitted from the lower end of the main body 252*a*, and after the limiting member 252*c* is assembled again with the main body 252*a*, the sealing element 253 is limited by the limiting member 252*c* and the limiting portion 252*b* jointly. In such a way, the sealing element 253 is positioned reliably to improve sealing performance, and it is simpler and more convenient to assemble and disassemble the first switch unit 25, and it is convenient to repair and replace the sealing element 253. When the switch button 251 is actuated, the sealing element 253 may be hermetically attached to the first air inlet 21*a* or away from the first air inlet 21*a*. In summary, by providing the sealing element 253 on the connecting member 252, the sealing element 253 can be pressed against the first air inlet 21*a* when the switch button 251 is retracted into the first air inlet 21*a*, such that the first air inlet 21*a* is sealed, otherwise, the first air inlet 21*a* and the air inlet passage 21*b* are intercommunicated.

Referring to FIGS. 9 and 10 again, the switch button 251 is provided with a guide part 254 extending outwards, and the amount of the guide part 254 is two preferably, and the two guide parts 254 are configured at two opposite sides of the switch button 251. A guide plate 211 is extended downwards from the inner side of the housing 21, and a guide rail 212 is configured at two sides of the guide plate 211 symmetrically, and specifically, the guide parts 254 are slidably configured on the guide rail 212 to actuate the switch button 251. Preferably, the guide rail 212 is a spiral rail. By providing the spiral rail, the guide part 254 is slid on the spiral rail, so that the switch button 251 can be rotated while moving up and down, thereby driving the seal element 253 to move, so that the first air inlet 11*a* can be disconnected or intercommunicated with the air inlet passage 11*b*. In addition, the highest point and the lowest point of the spiral rail are respectively provided with an engaging groove 213 which is engaged with the guiding part 155 to position the switch button 251. By providing the engagement groove 113, the guide part 255 can be positioned at the highest point or the lowest point to position the current state of the switch button 251 to maintain the disconnection or connection state of the first air inlet 21*a* and the air inlet passage 21*b*, thereby achieving the function of sealing or continuous inflation.

Referring to FIG. 9 again, the first switch unit 25 further includes a spring element 256 configured between the switch button 251 and the housing 21, to supply a spring force to the switch button 251 for extruding from the housing 21. In such a way, the switch button 251 can be automatically reset to improve the convenience of operation. Preferably, the spring element 256 is a compression spring. In this embodiment, when the guiding part 254 is engaged in the engaging groove 213 of the highest point of the spiral rail, the compression spring is in an extended state, the switch button 251 extends out of the first air inlet 21*a*, and the sealing element 253 is away from the first air inlet 21*a*. When the guiding part 254 is engaged in the engaging groove 213 at the lowest point of the spiral rail, the compression spring is in a compressed state, the switch button 251 is retracted into the first air inlet 21*a*, and the sealing element 253 is sealed to the first air inlet 21*a*, therefore the first air inlet 21*a* and the second inflation inlet 251*b* are intercommunicated with the air inlet passage 21*b*. The second switch unit 26 has the same structure as the first switching unit 25, except that the second switch unit 26 controls disconnection or connection between the air outlet 21*e* and the air outlet passage 21*d*. It's easy for person skilled in the art to know the structure and connection relationship of the second switch unit 26 according to the structure and connection relationship of the first switch unit 25. Therefore, the structure and connection relationship of the second switch unit 26 are not repeated here.

Specifically, an electric control box 214 is configured in the housing 21, in which a circuit board for controlling the motor 22 is set, and the electric control box 214 is configured at a side of the housing 21.

Figure 11:
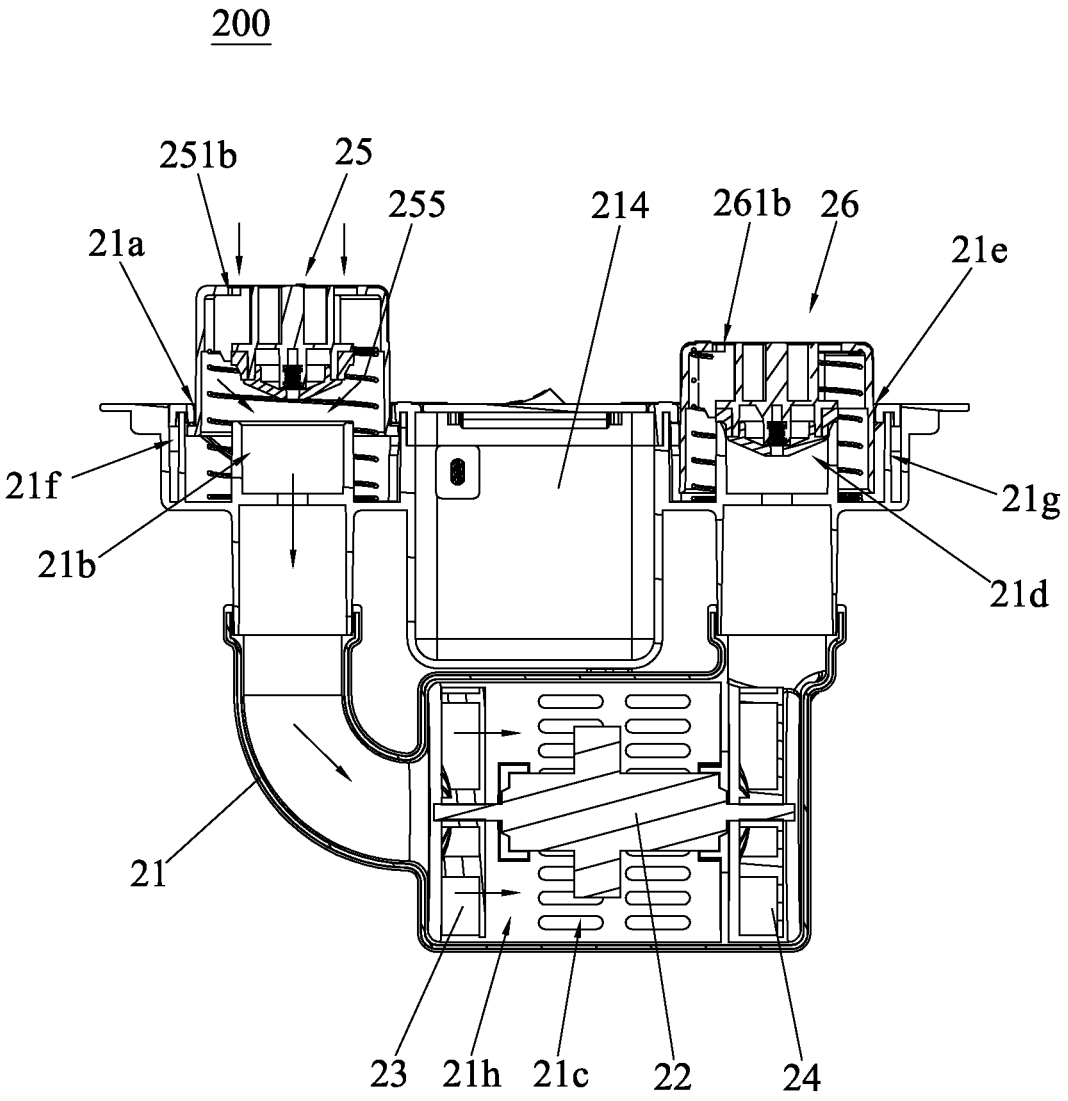
FIG. 11 shows a status of the air pump during inflation according to the second embodiment of the present invention.
Figure 12:
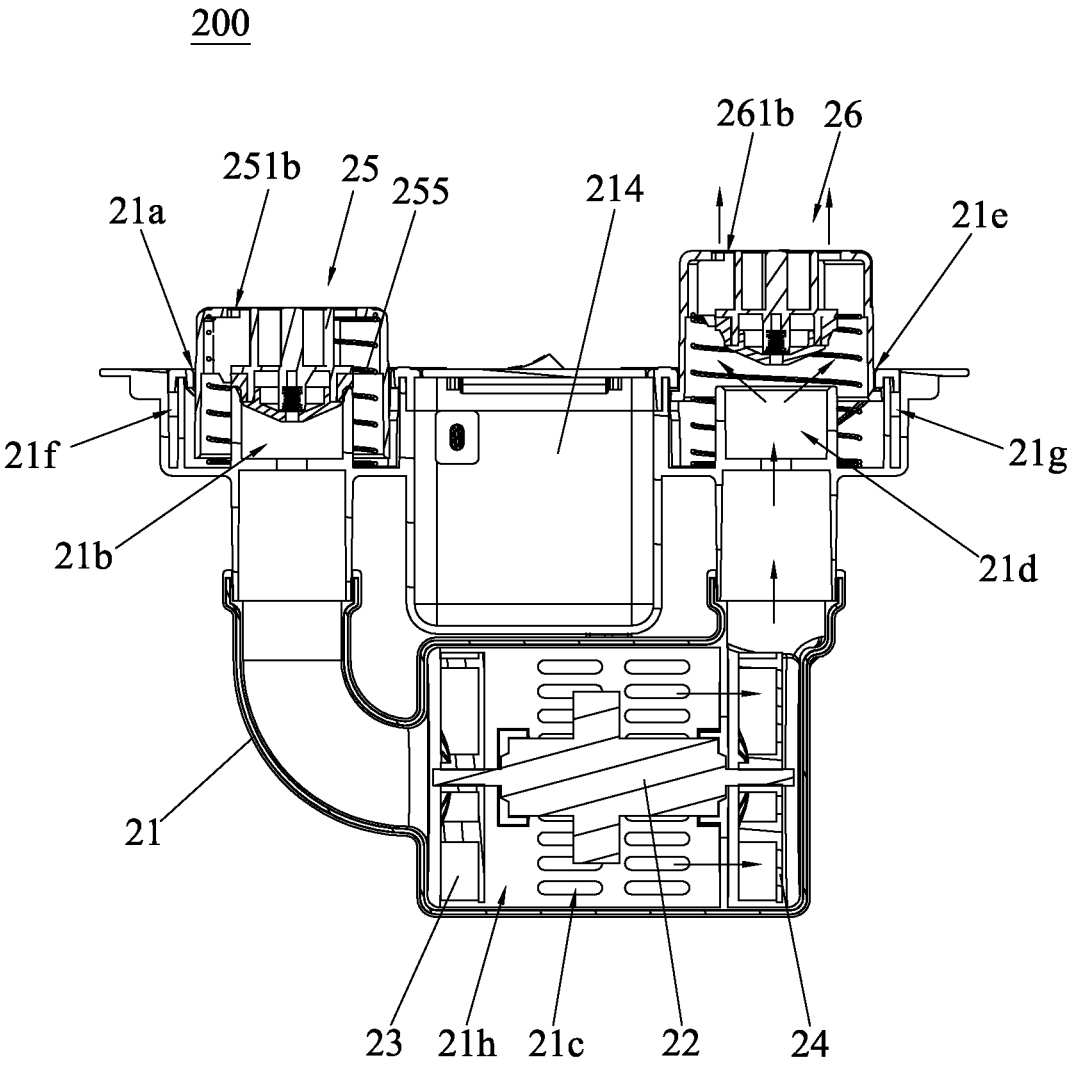
FIG. 12 shows a status of the air pump during deflation according to the first embodiment of the present invention.

Referring to the above and in conjunction with FIGS. 11 and 12, the working principle of the air pump 200 of the second embodiment follows.

As shown in FIG. 11, before the inflation, the first switch unit 25 is operated, and the switch button 251 is turned to rotate. At this time, the guiding part 254 is withdrawn from engaging groove 213 at the lowest point of the spiral rail, and slides along the spiral rail to reach the highest point thereby engaging in the engaging groove 213. In the process, the state of the switch button 251 is turned from the closed state to the opened state, that is, the switch button 251 is extruded out of the first air inlet 11*a*, and the sealing element 253 is turned to be away from the first air inlet 21*a* to make the first air inlet 21*a* communicate with the air inlet passage 21*b*. The second switch unit 26 keeps closing the air outlet 21*e*. Then, the motor 22 is activated to rotate the two output shafts, and the first fan 23 and the second fan 24 are simultaneously rotated. Since the first air inlet 21*a* is in communication with the air inlet passage 21*b*, the airflow flows from the first air inlet 21*a* into the first receiving cavity 21*f* under the actuation of the first fan 23, and enters the motor receiving cavity 21*h* through the first air inlet 21*a*, and finally inflates the air bag from the inflation inlet 21*c* into the air bag. Further, when the second switch unit 26 closes the air outlet 21*e*, the airflow cannot be discharged outward from the air outlet 21*e* although the second fan 24 is rotating. After the air bag is fully inflated, the motor 12 is stopped, meanwhile the first switch unit 25 is turned to rotate in the reverse direction, causing the guiding part 254 disengage from the lowest point of the spiral rail and then engage in the engaging groove 213 automatically at the highest point of the spiral rail. In this process, the switch button 251 is changed from an open state to a closed state, that is, the switch button 251 is retracted into the first air inlet 21*a*, and the sealing element 253 is actuated to seal the first air inlet 21*a*. At this time, the first air inlet 21*a* and the second inflation inlet 251*b* are blocked from the air inlet passage 21*b*, and the first air inlet 21*a* and the second inflation inlet 251*b* are closed by the first switch unit 25.

As shown in FIG. 12, during the deflation, the second switch unit 26 is operated, and the operation of the second switch unit 26 and each component therein are the same as those of the first switch unit 25. In such a way, the air outlet 21*e* and the second inflation inlet 261*a* can be opened to communicate the air outlet 21*e* and the second inflation inlet 261*a* with the exhaust passage 21*d*. After that, the motor 22 is restarted, so that the first fan 23 and the second fan 24 rotate, and the airflow in the air bag flows into the motor receiving cavity 21*h* from the inflation inlet 21*c*, and passes through the air outlet passage 21*d* to reach the second receiving cavity 21*g*, and is finally discharged to the outside from the air outlet 21*e* and the second inflation inlet 261*a*. After the air in the air bag is completely discharged, the motor 22 is stopped while the second switch unit 26 is operated to block the air outlet 21*e* and the second inflation inlet 261*a* from the air outlet passage 21*d*. That is, the first air inlet 21*a* is closed by the second switching device 26.

Figure 13:
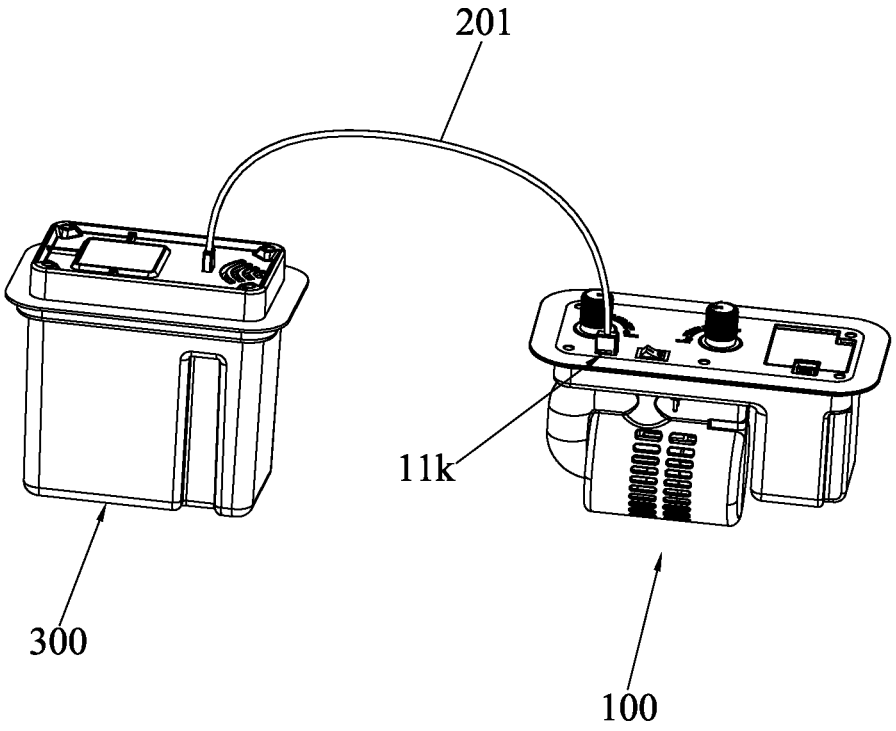
FIG. 13 is a structure view of an air pump according to a third embodiment of the present invention.
Figure 14:
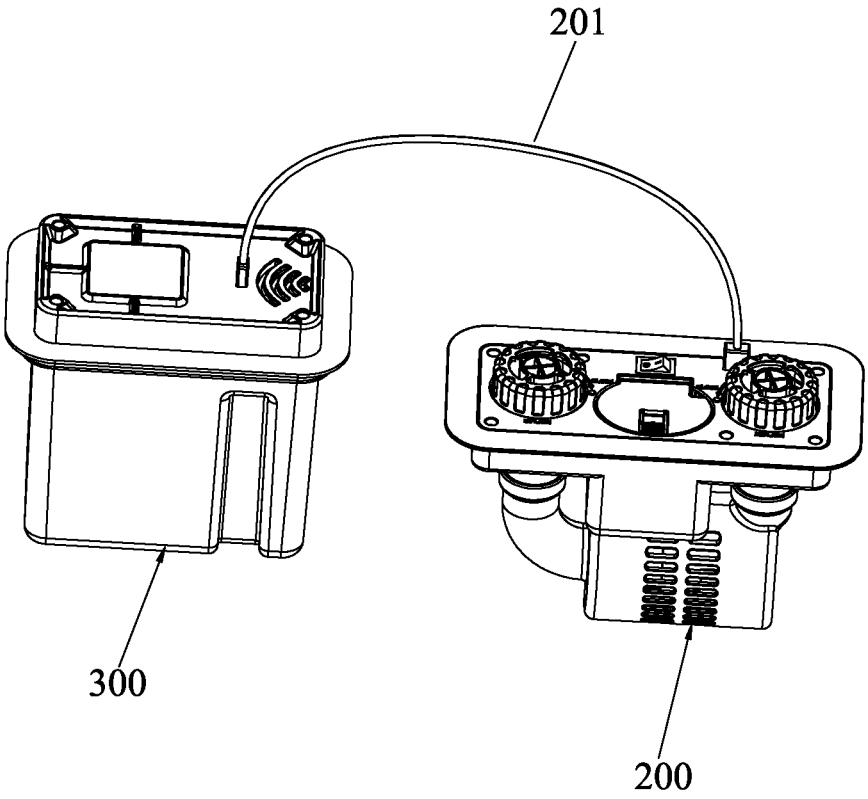
FIG. 14 is another structure view of air pump according to the third embodiment of the present invention.

As shown in FIG. 13 and FIG. 14, the structure of the air pump according to the third embodiment of the present invention is shown.

In this embodiment, the air pump is modified by adding a separated automatic air replenishing pump 300 on the basis of the air pump 100 of the first embodiment, or on the basis of the air pump 200 of the second embodiment. Specifically, the housing of the air pump 100 is provided with a USB interface 11*k* connected to the circuit board mentioned above, by means of a USB data cable 201, the automatic air replenishing pump 300 can be connected to the USB interface 11*k*, so as to achieve the electronic connection of the air pump 100. In normal operation, the air pump 100 is started to inflate the air bag. However, since the air pump 100 generates a large noise during operation, which seriously affects the daily rest of the surrounding people once the air pump 100 is started at rest time. Therefore, it's improved to provide the automatic air replenishing pump 300 which is quiet during operation. In addition, by providing the USB interface 11*k*, the air pump 100 and the automatic air replenishing pump 300 can be set in a separate form, and can be connected and used as needed, which reduces costs and increases flexibility in production and use. The structure and principle of the above-mentioned automatic air replenishing pump 300 are the same as those of the conventional air replenishing pump integrated in the air pump, and are well known to those skilled in the art, which will not be described in detail therefore.

The above is only the preferred embodiment of the present application, and the scope of the application is not limited thereto, and thus equivalent changes made by the scope of the present application are still within the scope of the present application.

What is claimed is:

1. An air pump, comprising:

a housing, provided with an first air inlet, an air inlet passage, an inflation inlet, an air outlet passage and an air outlet;

a motor, having two output shafts;

a first fan, connected with one of the output shafts of the motor and located at one end of the air inlet passage;

a second fan, connected with another of the output shafts of the motor and located at one end of the air outlet passage, the second fan and the first fan being configured to rotate in a same direction, and the inflation inlet being located between the first fan and the second fan;

a first switch unit, configured at another end of the air inlet passage to connect or disconnect the first air inlet with the air inlet passage; and a second switch unit, configured at another end of the air outlet passage to connect or disconnect the air outlet with the air outlet passage.

2. The air pump according to claim 1, wherein a motor receiving cavity is provided within the housing, in which the motor, the first fan and the second fan are received, one end of the motor receiving cavity is intercommunicated with one end of the air inlet passage, and another end of the motor receiving cavity is intercommunicated with one end of the air outlet passage, and the inflation inlet is configured at a side wall of the motor receiving cavity.

3. The air pump according to claim 1, wherein a first receiving cavity and a second receiving cavity are provided with the housing, the first receiving cavity is intercommunicated with the first air inlet and the air inlet passage respectively, the second receiving cavity is intercommunicated with the air outlet and the air outlet passage, the first switch unit is configured in the first receiving cavity, and the second switch unit is configured in the second receiving cavity.

4. The air pump according to claim 1, wherein the first switch unit and/or the second switch unit are configured to be rotatable relative to the housing, so as to connect or disconnect the first air inlet with the air inlet passage, and/or connect or disconnect the air outlet with the air outlet passage.

5. The air pump according to claim 1, wherein the first switch unit and/or the second switch unit are configured to be movable relative to the housing, so as to connect or disconnect the first air inlet with the air inlet passage, and/or connect or disconnect the air outlet with the air outlet passage.

6. The air pump according to claim 1, wherein the first switch unit comprises a switch button, a support plate configured at a side of the switch button, and a sealing element configured on the support plate, the switch button is extruded out of the first air inlet, and the sealing element is sealed on the first air inlet or departs from the first air inlet when the switch button is actuated.

7. The air pump according to claim 6, wherein a limiting portion is extended from a side wall of the switch button, and the sealing element is configured between the limiting portion and the support plate.

8. The air pump according to claim 1, wherein the first switch unit comprises a switch button having a cavity therein, a connecting member configured in the cavity, and a sealing element sleeved on the connecting member, and the sealing element is tightly pressed on the first air inlet or departs from the first air inlet when the switch button is actuated.

9. The air pump according to claim 8, wherein the connecting member comprises a main body, a limiting portion extended from an outer wall of the main body, and a limiting member detachably configured at a lower end of the main body, the sealing element is configured between the limiting portion and the limiting member.

10. The air pump according to claim 8, wherein the switch button is provided with a second inflation inlet which is interconnected with the cavity.

11. The air pump according to claim 6, wherein the switch button is provided with a guide part, a guide rail is configured in the housing, and the guide part is slidably configured on the guide rail to actuate the switch button.

12. The air pump according to claim 11, wherein the guide rail is a spiral rail.

13. The air pump according to claim 12, wherein two engaging grooves are configured at two ends of the spiral rail respectively.

14. The air pump according to claim 13, wherein the first switch unit further comprises a spring element configured between the switch button and the housing, to supply a spring force to the switch button for extruding from of the housing.

15. The air pump according to claim 1, wherein the second switch unit has identical structure with the first switch unit.

16. The air pump according to claim 1, wherein an electric control box is configured in the housing, in which a circuit board for controlling the motor is set.

17. The air pump according to claim 16, further comprising an automatic air replenishing pump, wherein the housing is provided with a USB interface connected with the circuit board, and the automatic air replenishing pump is connected with the USB interface via a cable to connect with the air pump.

* * * * *